United States Patent [19]

Sweet et al.

[11] 4,148,483

[45] Apr. 10, 1979

[54] HANDLELESS HAND RACKET

[76] Inventors: Alvin H. Sweet, 5168 Wood Ave. Apt. B, South Gate, Calif. 90280; Don A. Sweet, 8371 Standustrial St., Stanton, Calif. 90680

[21] Appl. No.: 894,905

[22] Filed: Apr. 10, 1978

[51] Int. Cl.[2] ..... A63B 59/00

[52] U.S. Cl. ..... 273/67 R

[58] Field of Search ..... 273/67 R, 67 B, 73 R, 273/73 C, 73 D, 73 E, 73 L, 76, 96 R, 96 D, 126 R, 126 A, DIG. 4, 102 R

[56] References Cited

U.S. PATENT DOCUMENTS

| | | | |
|---|---|---|---|
| 1,402,799 | 1/1922 | Ryan | 273/67 B |
| 1,523,899 | 1/1925 | Rittenhouse | 273/67 B |
| 1,523,900 | 1/1925 | Rittenhouse | 273/67 B |
| 1,700,251 | 1/1929 | Contolini | 273/67 B |
| 3,048,399 | 8/1962 | Breifbach | 273/73 R X |
| 3,516,670 | 6/1970 | D'Agostino et al. | 273/DIG. 4 |
| 3,734,499 | 5/1973 | Goldstein | 273/73 R X |
| 3,966,207 | 6/1976 | Pass | 273/73 D |
| 4,017,076 | 4/1977 | Bai | 273/102 R |
| 4,034,984 | 7/1977 | Crawford | 273/96 D |

FOREIGN PATENT DOCUMENTS

| | | | |
|---|---|---|---|
| 282936 | 2/1966 | Australia | 273/96 R |
| 1043897 | 11/1958 | Fed. Rep. of Germany | 273/73 D |
| 2135048 | 2/1973 | Fed. Rep. of Germany | 273/67 R |
| 1268277 | 6/1961 | France | 273/67 B |
| 28855 | 6/1964 | German Democratic Rep. | 273/67 B |
| 1643 of | 1894 | United Kingdom | 273/73 D |
| 2717 of | 1909 | United Kingdom | 273/73 D |

*Primary Examiner*—Richard J. Apley
*Attorney, Agent, or Firm*—Howard L. Johnson

[57] ABSTRACT

Handleless hand racket formed of three molded plastic parts joined together into assembly formed of (A) channel-shape backing support of a little larger size than the human palm, (B) opposing pair of edge bows, cross linked by longitudinal series of resilient or repellent integral strings, the bows being attached to respective raised edges of the backing support so as to hold the channel-overlying strings under tension, and (C) bulbous hand knob shaped for grasping by a player's clenched fingers with the end of the knob held against the palm, or alternately with straight fingers extended along opposite sides of the knob.

4 Claims, 5 Drawing Figures

HANDLELESS HAND RACKET

BACKGROUND OF THE INVENTION

The fascination of children as well as adults for playing multitudinous games with a ball goes back at least to the beginning of recorded history. Various instruments such as bats or rackets have been involved, particularly when the interplay involves a group of persons. However the simplest and perhaps most universal of such "games" is that wherein an individual simply hits a ball against a (usually upright) surface in such manner or position that he can intercept and repell it in a repetitive pattern, thus continuing the play indefinitely. This can be done simply by the player's gloved or naked hand, or by use of a handled instrument such as a paddle board or a tennis racket. There have also been wearable glove-like devices which support a forward cross-strung grid which serves to repell an impinging ball. These were without a handle and depended upon the user keeping his hand open or only slightly cupped within the glove structure.

STATEMENT OF THE INVENTION

In contrast to the preceding, the present invention provides such a handleless hand racket which also dispenses with any hand engaging means (such as straps or glove) and which locates a central, rearward-projecting knob which can be grasped by the player in varied positions of the hand and especially by closing his fingers around the knob. The forward face of the knobed backing surface disposes a mutually parallel series of longitudinal strings, which collectively constitute a ball repell or rebound area and are formed integral with edge-attachment strips or bows by which they are secured spacedly overlying the backing surface and are retained under longitudinal tension by the bows being attached to the backing surface while the latter is under stress. Such strings do not require cross connections as are found in conventional "strung" rackets. The three parts of the assembly—knob, channel-shaped backing surface, and pair of string connected bows can each be injection molded of synthetic resin or plastic, such as polyethylene, with integral projecting lugs by which they are press-fit or coupled together. The projecting knob structure allows the user to "handle" the racket by placing his outstretched hand against the backing surface with two fingers on each side of the knob, and alternately to grasp the knob with his clenched fingers; that is, from time to time the user may shift from one position to the other, or just retain the single position which he favors. Such a racket may be used by an individual alone in bouncing a ball off of a wall, or it may be used by groups of players as in tennis or other games. In some instances a player may wish to use one in each hand simultaneously.

Altho the backing support and hand knob can be made of other material, polyethylene resin is uniquely effective among the range of available plastics for injection molding the "strings" or the B-unit. Other plastics prove to be either too soft (hence lack resilience) or too hard (and break under repeated impact). In contrast, the effect of lengthwise tension applied to molded strands of polyethylene is to produce a long-lasting resilient repell or "bounce" area. Molding temperature is typically about 180° C.

DETAILED DESCRIPTION OF PREFERRED EMBODIMENT

Figure 1:
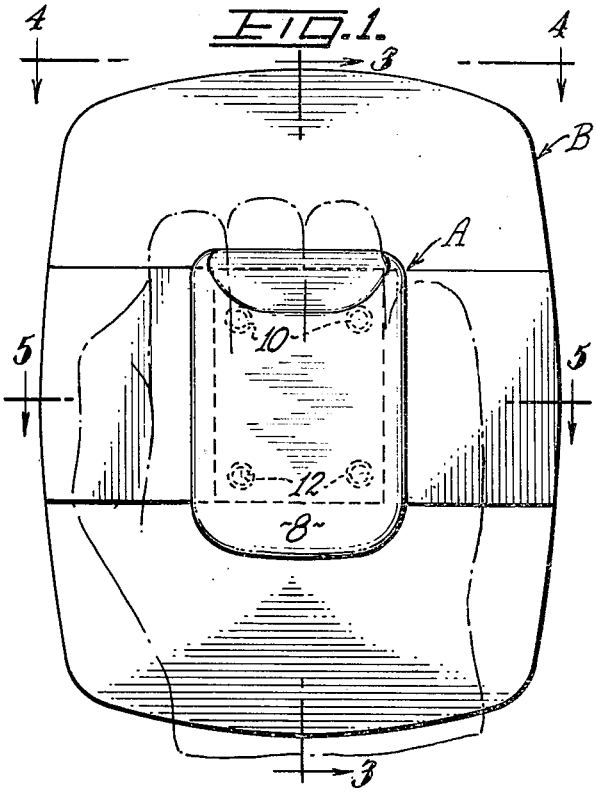
FIG. 1 is a rear elevational view of the hand racket held by a pleyer's overlying hand with fingers closed over the knob.
Figure 2:
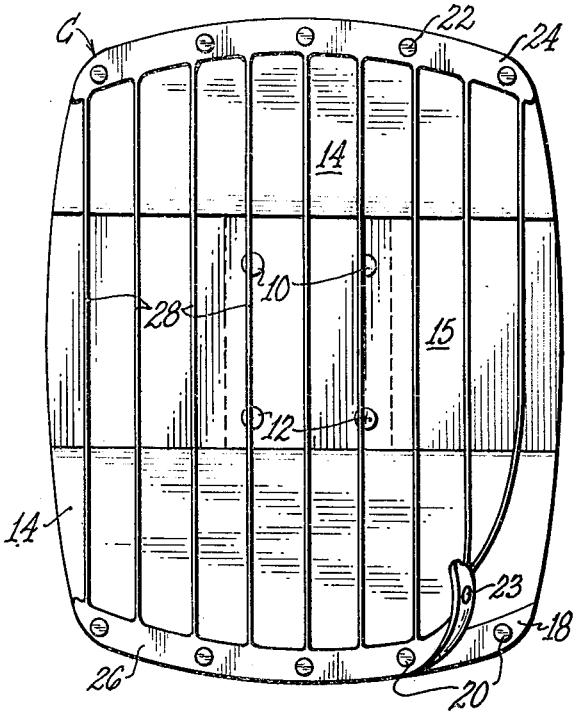
FIG. 2 is an elevational view of the contact or repell face of the racket with a corner of the lower bow turned up to display a pin attachment aperture.
Figure 3:
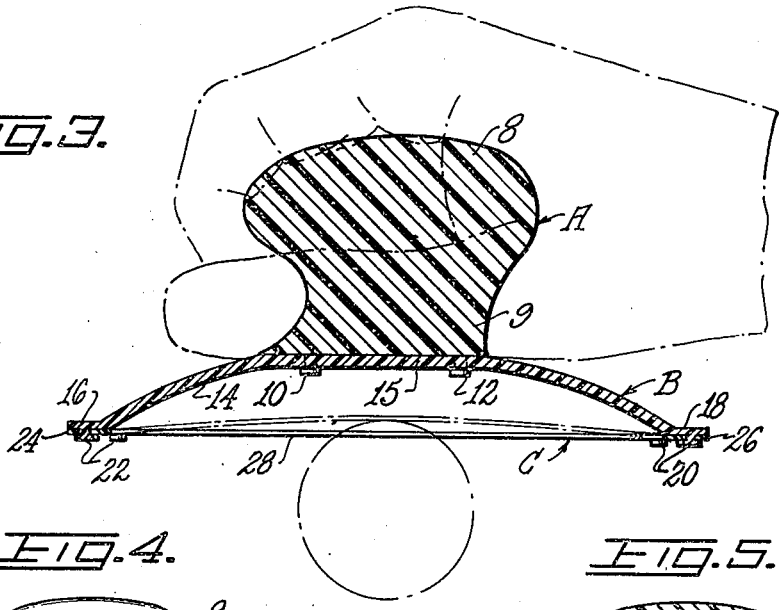
FIG. 3 is a longitudinal vertical section through the racket with the knob shown grasped by a player's clenched fingers, and in phantom, a ball impacting the strings.
Figure 4:
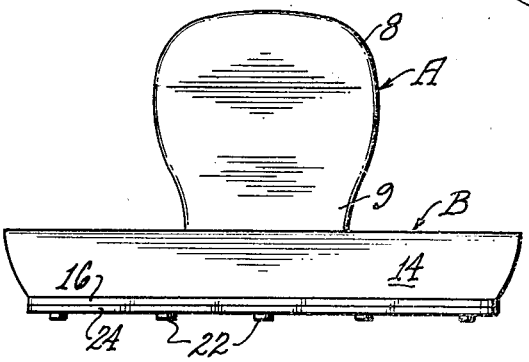
FIG. 4 is an end elevational view of the racket.
Figure 5:
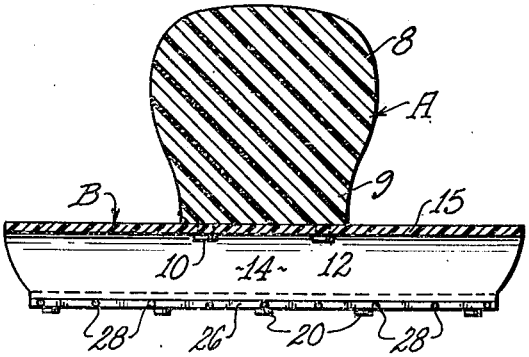
FIG. 5 is a transverse vertical section thru the racket.

Although it could be fabricated in other ways, as here illustrated the whole assembly is injection molded of the same synthetic plastic or resin (i.e. polyethylene), conveniently by molding three pieces: (A) a bulbous grab-knob formed with a generally flat top or convex head 8, somewhat restricted or undercut neck 9 and two or more bottom-projecting, headed lugs 10, 12; (B) a generally rectangular, backing surface or body of which the forward face 14 is formed like a shallow transverse trough 15 lying between a pair of outturned, flat-face ridges or edge walls 16, 18, each formed with an outward projecting series of headed, coupling pins or lugs 20, 22. The third piece C is a repell unit formed of a pair of flat end bows 24, 26 connected together by longitudinal, generally parallel, integral strings 28 which, as noted, collectively form an open field of taut strength or resilient deformity. The bows are formed with a series of apertures 23 corresponding to the spacing pattern of the respective rows of headed pins 20, 22. In assembly, the whole body member B is transiently bent like a "C" so that the two outturned edge walls 16, 18 bend a small amount toward each other and when in such position, the pins 20, 22 are pressed through the corresponding apertures 23, so that upon release, the strings 28 are maintained in lengthwise tension by the "unbending" body or surface (14, 15). Such continuous tension ensures retension of the bows 24, 26 on the pins 20, 22 as well as keeping the strings taut.

We claim:

1. A hand racket comprising in combination:

a backing surface having obverse and reverse faces, the obverse face being recessed, a repell unit comprising a pair of anchorage strips connected to each other by a plurality of generally parallel, laterally separated, resilient strings, the strips of said unit being secured to the backing surface adjacent opposite edges thereof by fastening means disposing said strings spacedly overlying said recessed face, said backing surface being stressed at its opposite anchorage strip connecting ends so as to lengthwise tension the connecting strings, and a hand-grasp knob projecting centrally rearward from said reverse face by which a player may amnually hold the racket by clenching his fingers about the knob and thus by arm and wrist movement manipulate the racket to selected positions wherein the strings may collectively meet and repell an oncoming ball upon its impact thereagainst.

2. A hand racket according to claim 1 which is formed of synthetic resin and said fastening means comprise integral pin elements jointly retained in the anchorage strips and backing surface.

3. A hand racket according to claim 1 wherein said stressable backing surface and said repell until including strings and anchorage strips are each cast integral of polyethylene resin.

4. In combination with a racket body comprising a recessed area and mutually aligned fastening means disposed adjacent opposite raised edges thereof, the improvement comprising a pair of anchorage strips held by the respective fastening means and connected to each other by a plurality of generally parallel, laterally separated, resilient strings formed integral with said anchorage strips and disposed spacedly overlying said recessed area, said racket body being stressed between said raised edges do as to lengthwise tension the connecting strings.

* * * * *

UNITED STATES PATENT AND TRADEMARK OFFICE

CERTIFICATE OF CORRECTION

PATENT NO. : 4,148,483

DATED : April 10, 1979

INVENTOR(S) : Alvin H. Sweet et al.

It is certified that error appears in the above-identified patent and that said Letters Patent are hereby corrected as shown below:

Column 3, line 4, "until" should read --- unit ---.

Column 4, line 7, "do" should read --- so ---.

Signed and Sealed this

*Thirty-first* Day of *July 1979*

[SEAL]

*Attest:*

*Attesting Officer*

LUTRELLE F. PARKER

*Acting Commissioner of Patents and Trademarks*